US008567689B2

(12) United States Patent
Eisenhower et al.

(10) Patent No.: US 8,567,689 B2
(45) Date of Patent: Oct. 29, 2013

(54) SANITARY OPERATOR OF A HOT WATER HEAT PUMP

(75) Inventors: Bryan A. Eisenhower, East Hartford, CT (US); Tobias Sienel, East Hampton, MA (US); Nicolas Pondico-Cassou, Lyons (FR)

(73) Assignee: Carrier Corporation, Syracuse, NY (US)

( * ) Notice: Subject to any disclaimer, the term of this patent is extended or adjusted under 35 U.S.C. 154(b) by 3449 days.

(21) Appl. No.: 10/943,517

(22) Filed: Sep. 17, 2004

(65) Prior Publication Data

US 2006/0071090 A1 Apr. 6, 2006

(51) Int. Cl.

| | |
|---|---|
| ***B01B 1/00*** | (2006.01) |
| *F24H 4/04* | (2006.01) |
| *F24H 4/00* | (2006.01) |
| *F24H 4/02* | (2006.01) |

(52) U.S. Cl.
USPC ..... 237/8 A; 237/8 R; 237/2 A; 236/12.14; 137/332; 122/406.1; 122/33; 122/31.1; 122/18.2

(58) Field of Classification Search
USPC ..... 237/2 A, 8 R, 8 A; 236/12.12, 12.14; 137/332, 625.33; 122/406.1, 406.5, 33, 122/31.1, 18.2
See application file for complete search history.

(56) References Cited

U.S. PATENT DOCUMENTS

| | | | | | |
|---|---|---|---|---|---|
| 2,948,277 | A | * | 8/1960 | Dennis | 122/13.01 |
| 3,107,052 | A | * | 10/1963 | Garrison | 126/591 |
| 3,602,200 | A | * | 8/1971 | Evans et al. | 122/264 |
| 3,960,322 | A | * | 6/1976 | Ruff et al. | 62/228.1 |
| 4,044,754 | A | * | 8/1977 | Cronin et al. | 126/588 |
| 4,048,981 | A | * | 9/1977 | Hobbs, II | 126/584 |
| 4,055,163 | A | * | 10/1977 | Costello et al. | 126/654 |
| 4,124,177 | A | * | 11/1978 | Timmerman | 237/2 B |
| 4,169,460 | A | * | 10/1979 | Popovich et al. | 126/589 |
| 4,226,364 | A | * | 10/1980 | Utesch | 237/63 |
| 4,232,656 | A | * | 11/1980 | Teagan | 126/588 |
| 4,263,961 | A | * | 4/1981 | Morawetz et al. | 165/111 |
| 4,340,033 | A | * | 7/1982 | Stewart | 126/586 |
| 4,341,201 | A | * | 7/1982 | Ziemann | 126/585 |
| 4,458,669 | A | * | 7/1984 | Lee | 126/618 |
| 4,474,169 | A | * | 10/1984 | Steutermann | 126/592 |
| 4,480,632 | A | * | 11/1984 | Klier et al. | 126/568 |
| 4,492,091 | A | * | 1/1985 | Whitwell et al. | 62/180 |
| 4,503,839 | A | * | 3/1985 | Dunstan | 126/563 |
| 4,553,402 | A | * | 11/1985 | Cramer, Sr. | 62/235.1 |
| 4,573,327 | A | * | 3/1986 | Cochran | 62/238.6 |
| 4,668,536 | A | * | 5/1987 | Goodell et al. | 427/235 |
| 4,680,941 | A | * | 7/1987 | Richardson et al. | 62/184 |
| 4,709,554 | A | * | 12/1987 | Umemura et al. | 62/156 |
| 4,732,007 | A | * | 3/1988 | Dolan et al. | 62/79 |
| 4,803,955 | A | * | 2/1989 | Gonsalves | 119/71 |

(Continued)

*Primary Examiner* — Kang Hu
*Assistant Examiner* — Daniel E Namay
(74) *Attorney, Agent, or Firm* — Carlson, Gaskey & Olds, PC

(57) ABSTRACT

A method of sanitizing pipes, etc. in a hot water supply system includes the steps of normally heating water by driving water from a water storage tank, into a heat exchanger. Typically, a water pump is stopped once the water storage tank receives a particular percentage of hot water. However, when a sanitation mode is desired, the pump is not stopped, such that the water tank becomes all, or almost all, hot water. The hot water is then delivered to the pump, and from the pump to the heat exchanger. This hot water is thus operable to sanitize pipes and the pump.

13 Claims, 1 Drawing Sheet

(56) References Cited

U.S. PATENT DOCUMENTS

| | | | | | |
|---|---|---|---|---|---|
| 4,901,534 | A * | 2/1990 | Nakatsuno et al. | 62/81 |
| 5,103,078 | A * | 4/1992 | Boykin et al. | 219/494 |
| 5,168,546 | A * | 12/1992 | Laperriere et al. | 392/454 |
| 5,228,302 | A * | 7/1993 | Eiermann | 62/90 |
| 5,808,277 | A * | 9/1998 | Dosani et al. | 219/481 |
| 6,170,440 | B1 * | 1/2001 | Monnier et al. | 122/367.1 |
| 6,572,026 | B2 * | 6/2003 | Enander et al. | 237/12.3 B |
| 6,622,930 | B2 * | 9/2003 | Laing et al. | 237/80 |
| 6,638,397 | B1 * | 10/2003 | Camiener et al. | 202/161 |
| 7,156,895 | B2 * | 1/2007 | Rubin et al. | 95/8 |
| 2002/0102182 | A1 * | 8/2002 | Suddath et al. | 422/26 |
| 2006/0071090 | A1 * | 4/2006 | Eisenhower et al. | 237/2 A |

* cited by examiner

SANITARY OPERATOR OF A HOT WATER HEAT PUMP

BACKGROUND OF THE INVENTION

This invention relates to a method of periodically sanitizing the plumbing in a hot water supply system.

Most buildings are provided with a hot water supply system. Typically, a hot water supply system includes a pump for delivering water into a hot water tank. From the hot water tank, the water can be delivered to a downstream user such as a faucet, etc. The water delivered to the downstream user has a temperature that is generally set as desired by an occupant of the building.

Recently, the assignee of the present invention has developed a system wherein the water is heated in a heat exchanger, with the heat exchanger being provided with a heat source from a refrigerant cycle. There is a water storage tank with a pump delivering a cool water to be heated to the heat exchanger. The cool water is stored in the water storage tank. The hot water, having been heated at the heat exchanger, is also supplied to the tank. As known, the hot water will tend to keep separate from the cool water within the water storage tank. The pump is situated such that it generally draws the cool water to be sent through the heat exchanger.

A supply for delivering the hot water to the downstream user is situated such that it is likely to communicate with hot water when the water storage tank has hot water. A sensor within the water storage tank senses when there is a desired amount of hot water, and stops operation of the pump once there is sufficient hot water in the water storage tank. Typically, some percentage of the water storage tank would be full of hot water before the pump will be shut down. As an example, perhaps 80% of the water storage tank would be hot water with 20% remaining as cold water when the pump is stopped.

One problem with this type of system is there will be a likelihood of stagnant water between the water storage tank and the pump. This stagnant water will be cool, and included pipes will typically not be exposed to any hot temperature water. At the heat exchanger, and downstream of the heat exchanger, there is of course the hot water flow that will sanitize the pipes. However, there is a potential concern with sanitizing the pipe leading from the water storage tank to the pump, in the pump, and from the pump to the heat exchanger.

SUMMARY OF THE INVENTION

In a disclosed embodiment of this invention, a pump is operated in a manner such that hot water is periodically brought through the pipe connecting the water storage tank to the pump, and between the pump and the heat exchanger to disinfect these components.

In a preferred embodiment, the switch that typically shuts the pump down once a particular percentage of the water storage tank is full of hot water, is overridden during a sanitation mode. Sanitation mode may begin once the pump has been stopped for a predetermined period of time. Under such circumstances, and in the disclosed embodiment, the water storage tank is allowed to fill with hot water. The pump then draws this hot water through the pipes, thereby sanitizing the pipes. Once a particular period of time has passed, the system returns to normal operation.

These and other features of the present invention can be best understood from the following specification and drawings, the following of which is a brief description.

DETAILED DESCRIPTION OF THE PREFERRED EMBODIMENT

Figure 1:
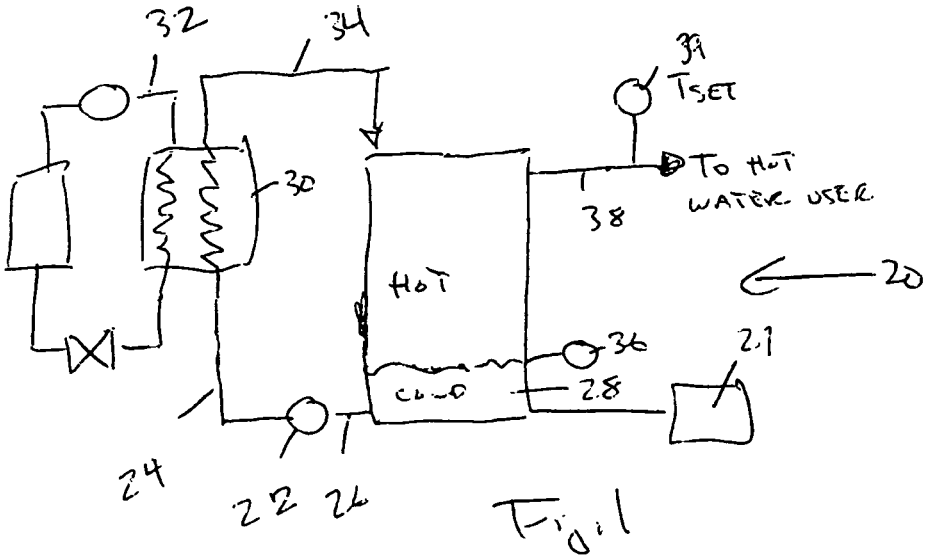
FIG. 1 is a schematic view of a hot water supply system incorporating the present invention.

A hot water supply system 20 is illustrated in FIG. 1. A pump 22 delivers a cool water supply 21 through a pipe 24, and from a pipe 26 that is connected to a water storage tank 28. Water storage tank 28 receives a cool water supply from water supply 21. The water from the pipe 24 is delivered into a heat exchanger 30. Heat exchanger 30 is connected with a refrigerant cycle 32 that includes a compressor, an expansion device, and an outdoor heat exchanger, as known. Preferably, the refrigerant cycle 32 operates as a transcritical refrigerant system, and utilizes CO2 as a refrigerant. However, other refrigerant systems maybe utilized within the scope of this invention.

The heat exchanger 30 receives a hot refrigerant, and heats the hot water passing from pipe 24 into a downstream pipe 34. The heated water is delivered into the water storage tank 28. As is known, the heated water and the cooler water will maintain themselves at separate levels within the water storage tank 28. A sensor 36 senses the level of hot water relative to the cool water within the water storage tank 28, and is operable to stop operation of the pump 22 once a predetermined percentage of the water storage tank 28 is hot water. As an example, this predetermined percentage may be 80%. At this percentage, and as illustrated in the schematic, the pipe 26 leading to the pump 22 would still communicate with the cool water portion of the tank 28. The efficiency of the hot water heating system is greatly increased when it is cool water that is delivered into the heat exchanger 30.

A pipe 38 leads to a downstream use such as a faucet, etc. A temperature request element 39, such as a faucet handle, etc. allows a user to request a particular temperature of hot water.

As mentioned above, the above-described system has been recently developed by the assignee of the present invention. The present invention is directed to periodically disinfecting or sanitizing the pipe 26, pump 22 and pipe 24.

Figure 2:
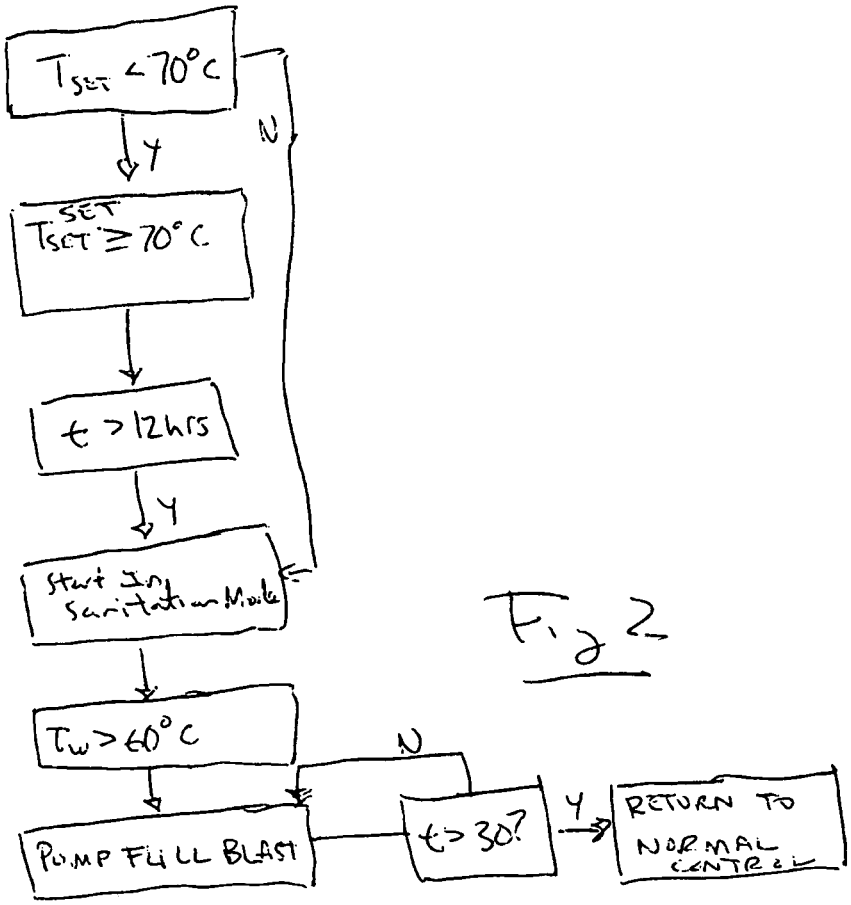
FIG. 2 is a schematic of the method of the present invention.

As shown in the flowchart of FIG. 2, once a request for additional hot water has been sent, a control for the system and pump 22 initially asks what temperature is being delivered from the heat exchanger 30. If this temperature is less than 70° C., then a new temperature is set to override this existing temperature, and set the "desired" temperature to 70° C. Notably, 70° C. is but an example of a particular high temperature capable of fully sanitizing the flow lines. If the temperature is already at or above 70°, the flowchart proceeds directly to a sanitary mode.

Once the override temperature has been set, the flowchart next asks how long it has been since the last sanitation process has been performed. If a sufficient period of time has elapsed since the last sanitation process, then the pump is started in sanitary mode. In the example, a particular period of time t is 12 hours though it may be changed by the user (say one week or one month). The pump when operated in sanitary mode continues to drive water through the heat exchanger, and the switch 36 is not allowed to stop operation of the pump. Instead, the tank 28 is filled entirely with hot water, and preferably hot water at the higher set point (i.e., at or above 70° C.). By utilizing this method, soon, the water being passed from the water storage tank 28, into the pipe 26, through the pump 22, and into the pipe 24 will be at this high temperature. This will sanitize both the pipes and the pump. After a particular period of time (30 minutes in the disclosed example), the pump is again stopped.

The present invention thus provides a simplified method for fully sanitizing the pipes and pump in a hot water supply system.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of operating a hot water supply system comprising the steps of:

(1) providing a hot water supply system including a water storage tank, and a pump for delivering water from said water storage tank to a heat exchanger;

(2) operating said pump under normal conditions to draw a cool water from said water storage tank, and pass it through pipes communicating said water storage tank to said pump and to said heat exchanger, and monitoring an amount of cool water in said water storage tank relative to an amount of hotter water, and normally stopping operation of said pump passing cool water to said heat exchanger when the amount of hotter water relative to cool water reaches a predetermined amount; and (3) operating said system in a sanitation mode at which hotter temperature water is brought through said pipes and said pump, and in said sanitation mode, said pump not stopping operation when the amount of hotter water relative to cool water exceeds the predetermined amount, but continuing to pass water from said water storage tank through said heat exchanger such that a higher temperature water is brought through said pipes and said pump.

2. The method as set forth in claim 1, further comprising the steps of delivering hot water from said heat exchanger into said water storage tank.

3. The method as set forth in claim 2, wherein a switch operates when said pump is operating under step (2) to stop operation of said pump once a predetermined amount of hot water is received in said water storage tank.

4. The method as set forth in claim 3, wherein said switch is overridden in said sanitation mode such that hot water reaches a higher percentage within said water storage tank, and said hot water is delivered into said pipes, to said pump, and to said heat exchanger to sanitize said pipes and said pump.

5. The method as set forth in claim 1, wherein said heat exchanger further receives a hot refrigerant to heat said water.

6. The method as set forth in claim 1, wherein a user of the hot water system normally requests a particular temperature, and when the pump is in sanitation mode, if the particular requested temperature is not above a predetermined minimum sanitation temperature, the requested temperature for the water is set to a predetermined minimum sanitation temperature for step (3).

7. A hot water supply system comprising:

a water storage tank;

a pump for delivering water from said water storage tank to a heat exchanger;

at least one pipe for connecting said water storage tank to said heat exchanger;

a control for operating the system in a sanitation mode at which hotter temperature water is brought through said pipes and said pump;

and said control monitoring an amount of cool water in said water storage tank relative to an amount of hotter water, and said control normally stopping operation of said pump passing cool water to said heat exchanger when the amount of hotter water relative to cool water reaches a predetermined amount; and in said sanitation mode, said control not stopping operation even when the amount of hotter water relative to cool water exceeds the predetermined amount, but continuing to pass water from said water storage tank through said heat exchanger such that a higher temperature water is brought through said pipes and said pump.

8. The hot water supply system of claim 7, wherein hot water from said heat exchanger is delivered into said water storage tank.

9. The hot water supply system of claim 8, wherein a switch operates to stop operation of said pump once a predetermined amount of hot water is received in said water storage tank.

10. The hot water supply system of claim 9, wherein said switch is overridden in said sanitation mode such that hot water reaches a higher percentage within said water storage tank, and said hot water is delivered into said at least one pipe, to said pump, and to said heat exchanger to sanitize said at least one pipe and said pump.

11. The hot water supply system of claim 7, wherein said heat exchanger further receives a hot refrigerant to heat said water.

12. The hot water supply system of claim 7, wherein a user of the hot water system normally requests a particular temperature, and when the pump is in sanitation mode, if the particular requested temperature is not above a predetermined minimum sanitation temperature, the requested temperature for the water is set to a predetermined minimum sanitation temperature.

13. The hot water supply system of claim 7, wherein said heat exchanger is part of a refrigerant cycle, and said heat exchanger being combined in said refrigerant cycle with an expansion device, a compressor, and a second heat exchanger.

* * * * *